US011040392B2

(12) United States Patent
Abe et al.

(10) Patent No.: US 11,040,392 B2
(45) Date of Patent: Jun. 22, 2021

(54) CASTING DEVICE

(71) Applicant: TOYOTA JIDOSHA KABUSHIKI KAISHA, Toyota (JP)

(72) Inventors: Yoshikazu Abe, Toyota (JP); Takehisa Fujita, Nisshin (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 17/011,565

(22) Filed: Sep. 3, 2020

(65) Prior Publication Data

US 2021/0146428 A1 May 20, 2021

(30) Foreign Application Priority Data

Nov. 15, 2019 (JP) ..... JP2019-207070

(51) Int. Cl.
*B22D 23/00* (2006.01)
*B22C 9/10* (2006.01)
*B22C 9/06* (2006.01)

(52) U.S. Cl.
CPC ..... *B22C 9/108* (2013.01); *B22C 9/06* (2013.01); *B22D 23/003* (2013.01)

(58) Field of Classification Search
CPC .. B22C 9/08; B22C 9/082; B22C 9/06; B22D 23/00; B22D 23/003
See application file for complete search history.

(56) References Cited

U.S. PATENT DOCUMENTS 4,066,117 A * 1/1978 Clark ..... B22D 23/003 164/46
2014/0083646 A1* 3/2014 Waniuk ..... B22D 18/00 164/493

OTHER PUBLICATIONS

Eitaro Koya et al., "Photography of atomization phenomena in HPDC and development of simulation system for atomized flow by LES-VOF method" The technical paper JD18-25 presented at the 2018 Japan Die Casting Congress, 11 pages (with English Abstract).

* cited by examiner

*Primary Examiner* — Kevin P Kerns
*Assistant Examiner* — Steven S Ha
(74) *Attorney, Agent, or Firm* — Oblon, McClelland, Maier & Neustadt, L.L.P.

(57) ABSTRACT

A casting device includes a mold having a cavity, a supply path that is connected to a gate of the cavity and configured to supply a molten metal to the supply path, and a gas flow path that is connected to the supply path and configured to supply a gas to the supply path. In the casting device, a molten metal is atomized by causing the gas supplied from the gas flow path to collide with the molten metal passing through the supply path, and the atomized molten metal is supplied to the cavity.

6 Claims, 6 Drawing Sheets

CASTING DEVICE

CROSS-REFERENCE TO RELATED APPLICATION

This application claims priority to Japanese Patent Application No. 2019-207070 filed on Nov. 15, 2019, incorporated herein by reference in its entirety.

BACKGROUND

1. Technical Field

The present disclosure relates to a casting device.

2. Description of Related Art

A casting device is a device that manufactures a cast product by injecting a molten metal into a cavity of a mold. The technical paper JD18-25 presented at the 2018 Japan Die Casting Congress titled "Photography of atomization phenomena in HPDC and development of simulation system for atomized flow by LES-VOF method" discloses that effects such as reduction of an amount of defects in a cast product and improvement of elongation property of the product can be achieved by adopting an atomized flow for the molten metal to be injected into a cavity of the mold. The technical paper JD18-25 presented at the 2018 Japan Die Casting Congress titled "Photography of atomization phenomena in HPDC and development of simulation system for atomized flow by LES-VOF method" discloses a technology that the molten metal can be atomized by increasing a speed at which the molten metal passes through a gate (i.e. gate speed).

SUMMARY

As described above, by atomizing the molten metal supplied to the cavity of the mold, it is possible to reduce the amount of defects in the cast product. For example, the technical paper JD18-25 presented at the 2018 Japan Die Casting Congress titled "Photography of atomization phenomena in HPDC and development of simulation system for atomized flow by LES-VOF method" discloses a technology that the molten metal can be atomized by increasing a speed at which the molten metal passes through the gate (i.e. gate speed).

However, there is an issue that if the gate speed of the molten metal increases, an amount of heat transferred to a flow path of the molten metal and the mold also increases, which causes erosion and seizure. Therefore, there is a need for a technology that enables atomization of the molten metal without increasing the gate speed of the molten metal.

The present disclosure provides a casting device that is capable of atomizing the molten metal without increasing the gate speed of the molten metal.

A casting device according to an aspect of the present disclosure includes a mold having a cavity, a supply path that is connected to a gate of the cavity and configured to supply a molten metal to the cavity, and a gas flow path that is connected to the supply path and configured to supply a gas to the supply path. In the casting device, the molten metal is atomized by causing the gas supplied from the gas flow path to collide with the molten metal passing through the supply path, and the molten metal that is atomized is supplied to the cavity.

In the casting device according to the aspect of the present disclosure, the molten metal is atomized by causing the gas to collide with the molten metal passing through the supply path. Therefore, the molten metal can be atomized without increasing the speed of the molten metal that passes through the gate (i.e. gate speed).

According to the aspect above, the casting device may include a molten metal supply portion that connected to the supply path and is configured to supply the molten metal to the supply path. The molten metal supply portion may be configured such that a sectional area of the molten metal supply portion is smaller than a sectional area of the supply path at a portion at which the molten metal supply portion is connected to the supply path. With this configuration, the molten metal can be effectively diffused in the supply path, whereby atomization of the molten metal can be promoted.

According to the aspect above, the gas flow path may be disposed such that a direction in which the gas is supplied to the supply path forms an acute angle with respect to a direction in which the molten metal flows through the supply path. With this configuration, supply of the atomized molten metal to the cavity can be promoted while the molten metal in the supply path is atomized.

According to the aspect above, a sectional shape of the supply path may be circular, a plurality of the gas flow paths may be connected to a periphery of the supply path, and the gas flow paths may be each disposed such that the direction in which the gas is supplied to the supply path is deviated from a central axis of the supply path when the gas is supplied toward the direction in which the molten metal flows through the supply path. The sectional shape of the supply path is not limited to truly circular. The sectional shape of the supply path may be substantially circular. With this configuration, the flow of the molten metal in the supply path can be rotated. When the flow of the molten metal is rotated as described above, a centrifugal force acts on the molten metal, which promotes disturbance of the flow of the molten metal. Therefore, atomization of the molten metal is promoted.

According to the aspect above, a first end of the gas flow path may be connected to the supply path, a second end of the gas flow path may be connected to the cavity, and the gas may supplied from the cavity to the supply path through the gas flow path. With this configuration, the air can be discharged through the gas flow path from the portions of the cavity where the air is likely to accumulate, and thus it is possible to suppress accumulation of the air in the cavity. Accordingly, the quality of the cast product can be improved.

According to the aspect above, the gas flow path may include a first gas flow path and a second gas flow path. The first gas flow path may be connected to the supply path and configured to supply a first gas to the supply path. A first end of the second gas flow path may be connected to the supply path and a second end of the second gas flow path may be connected to the cavity, and the gas may be supplied from the cavity to the supply path through the second gas flow path. With this configuration, the gas for atomizing the molten metal can be sufficiently supplied to the supply path. Therefore, atomization of the molten metal flowing through the supply path can be promoted.

According to the aspect above, the present disclosure can provide a casting device that is capable of atomizing the molten metal without increasing the gate speed of the molten metal.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

First Embodiment

Figure 1:
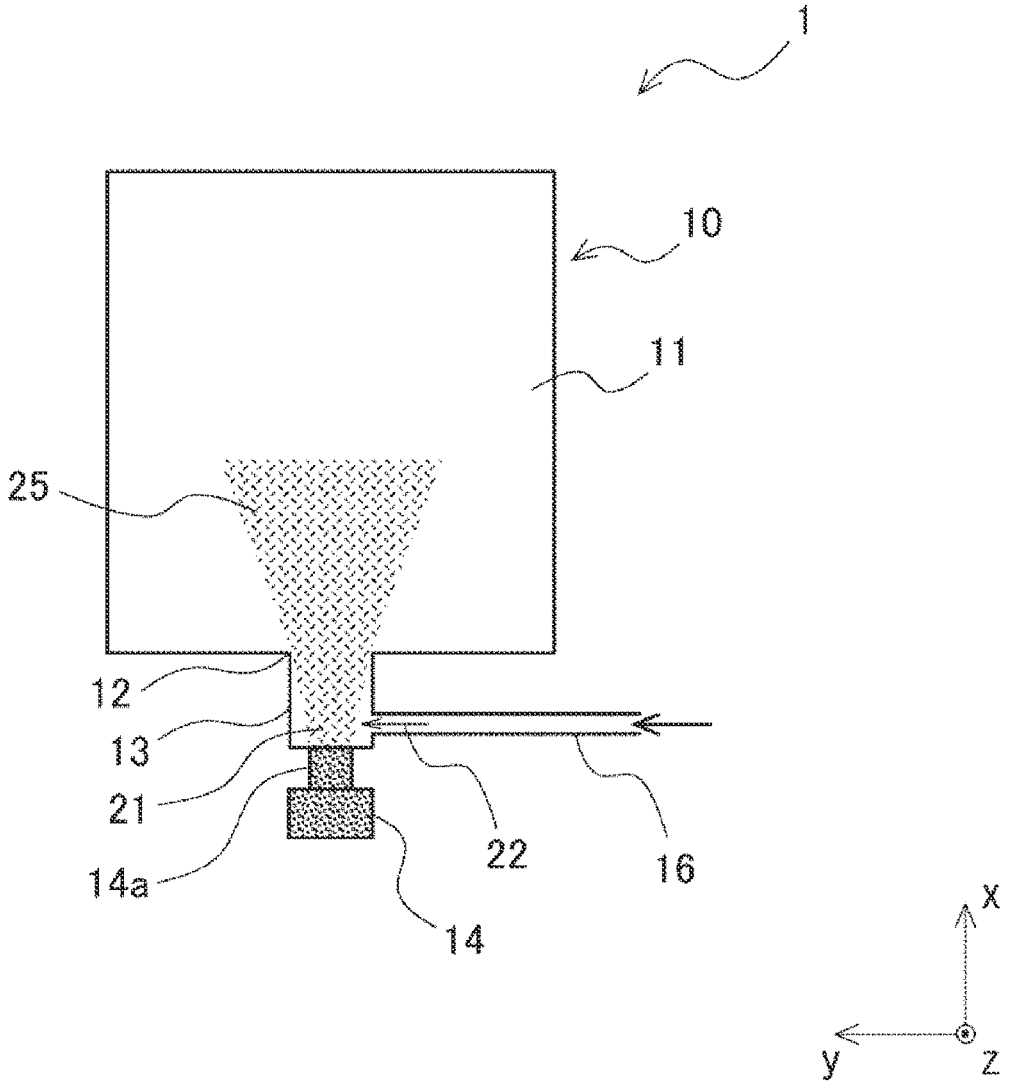
FIG. 1 is sectional view for explaining a casting device according to a first embodiment.

Hereinafter, an embodiment of the present disclosure will be described with reference to the drawings. FIG. 1 is sectional view for explaining a casting device according to a first embodiment. As shown in FIG. 1, a casting device 1 according to the first embodiment includes a mold 10, a supply path 13, a molten metal supply portion 14, and a gas flow path 16.

The mold 10 includes a cavity 11 corresponding to a shape of a cast product to be manufactured. For example, the mold 10 includes a fixed mold and a movable mold. The cavity 11 corresponding to the shape of the product is formed inside the mold 10 by coupling the movable mold to the fixed mold and fastening the molds together. A molten metal 25 is then supplied (injected) to the cavity 11 to cast the cast product and the movable mold is separated from the fixed mold to open the mold 10, whereby the cast product is taken out from the mold 10. Subsequently, the cast products can be continuously manufactured by repeating the process similar to the above. In this specification, the fixed mold and the movable mold are not illustrated in the drawings in order to simplify the drawings.

The supply path 13 is a flow path for supplying the molten metal 25 to the cavity 11. The supply path 13 is connected to a gate 12 of the mold 10 (the cavity 11), and supplies a molten metal 21 supplied from the molten metal supply portion 14 to the cavity 11 through the gate 12. The molten metal 21 moves through the supply path 13 in an x-axis direction. At this time, the molten metal 21 supplied from the molten metal supply portion 14 is atomized in the supply path 13, and the atomized molten metal 25 is supplied to the cavity 11. Note that, in this specification, a molten metal before atomization is referred to as the "molten metal 21", and an atomized molten metal is referred to as the "molten metal 25".

The molten metal supply portion 14 is connected to the supply path 13 to supply the molten metal 21 to the supply path 13. For example, the molten metal supply portion 14 may be configured using a plunger. Specifically, the plunger (not illustrated) includes a plunger sleeve and a plunger tip. The molten metal 21 is supplied to the supply path 13 by the plunger tip sliding in the plunger sleeve filled with the molten metal 21. The molten metal 21 is a liquid material obtained by melting a metal that is a material of a cast product, and for example, a molten metal obtained by melting an aluminum alloy.

The molten metal supply portion 14 is configured such that a sectional area of the molten metal supply portion 14 is smaller than a sectional area of the supply path 13 (a section perpendicular to the x-axis) at a portion 14*a* at which the molten metal supply portion 14 is connected to the supply path 13.

The gas flow path 16 is connected to the supply path 13 and supplies a gas 22 to the supply path 13. In the casting device 1 according to the first embodiment, the molten metal 21 is atomized by causing the gas 22 supplied from the gas flow path 16 to collide with the molten metal 21 passing through the supply path 13, and then the atomized molten metal 25 is supplied to the cavity 11.

In the example shown in FIG. 1, the gas 22 supplied to the supply path 13 is supplied (injected) from the gas flow path 16 in a y-axis direction. That is, the gas 22 is supplied from the gas flow path 16 in the y-axis direction toward the molten metal 21 that is flowing in the x-axis direction and the gas 22 collides with the molten metal 21 so as to atomize the molten metal 21. With this configuration, a shearing force of the gas 22 acts on the molten metal 21 as the gas 22 collides with the molten metal 21, which atomizes the molten metal 21.

Specifically, in the first embodiment, when the molten metal 25 is supplied from the supply path 13 to the cavity 11, the air in the supply path 13 is pushed out from the supply path 13 due to an inertia force of the molten metal 25 and a viscous force of the air. Consequently, the pressure in the supply path 13 becomes negative. This supplies the gas 22 from the gas flow path 16 to the supply path 13. Further, the molten metal supply portion 14 is configured such that the sectional area of the molten metal supply portion 14 is smaller than the sectional area of the supply path 13 (the section perpendicular to the x-axis) at the portion 14*a* at which the molten metal supply portion 14 is connected to the supply path 13. With this configuration, the molten metal 21 can be effectively diffused in the supply path 13, whereby atomization of the molten metal 21 can be promoted. That is, in the casting device 1 according to the first embodiment, the molten metal 21 can be atomized using the principle of air-assist atomizer.

The gas 22 supplied from the gas flow path 16 to the supply path 13 may be an air or an inert gas. As the inert gas, nitrogen gas and argon gas, for example, may be used.

Further, in the first embodiment, a flow rate (flow velocity) of the gas 22 supplied from the gas flow path 16 to the supply path 13 may be adjusted in accordance with a flow rate (speed) of the molten metal 21 passing through the supply path 13. For example, as the flow rate of the molten metal 21 passing through the supply path 13 increases, the flow rate of the gas 22 supplied from the gas flow path 16 to the supply path 13 may be increased. For example, the flow rate of the gas 22 supplied from the gas flow path 16 to the supply path 13 can be adjusted by providing a valve for adjusting the flow rate in the gas flow path 16.

As described above, in the first embodiment, when the molten metal 21 is flowing through the supply path 13, the gas 22 is supplied from the gas flow path 16 to the supply path 13 as the pressure in the supply path 13 becomes negative. However, in the first embodiment, the gas 22 may be supplied from the gas flow path 16 to the supply path 13 by supplying a pressurized gas to the gas flow path 16. For example, a compressed air that is pressurized at a predetermined pressure may be supplied from the gas flow path 16 to the supply path 13. With this configuration, the speed of the gas 22 that collides with the molten metal 21 passing through the supply path 13 increases and thus a collision energy increases. Therefore, atomization of the molten metal 21 can be promoted.

As described above, in the casting device 1 according to the first embodiment, the molten metal 21 is atomized by causing the gas 22 to collide with the molten metal 21 passing through the supply path 13. Therefore, the molten metal can be atomized without increasing the speed of the molten metal passing through the gate 12 (i.e. gate speed). Further, in the casting device 1 according to the first embodiment, there is no need to increase the gate speed. Therefore, an increase in the amount of heat transferred to the flow path of the molten metal and the mold can be suppressed, which can suppress occurrence of erosion and seizure.

In the first embodiment, the gas 22 supplied to the supply path 13 may be heated in advance. Heating of the gas 22 in advance can suppress the molten metal 21 from cooling by the gas 22 when the gas 22 collides with the molten metal 21 passing through the supply path 13. Therefore, it is possible to suppress the molten metal 21 from turning into metal particles due to the lowered temperature of the molten metal 21.

Figure 2:
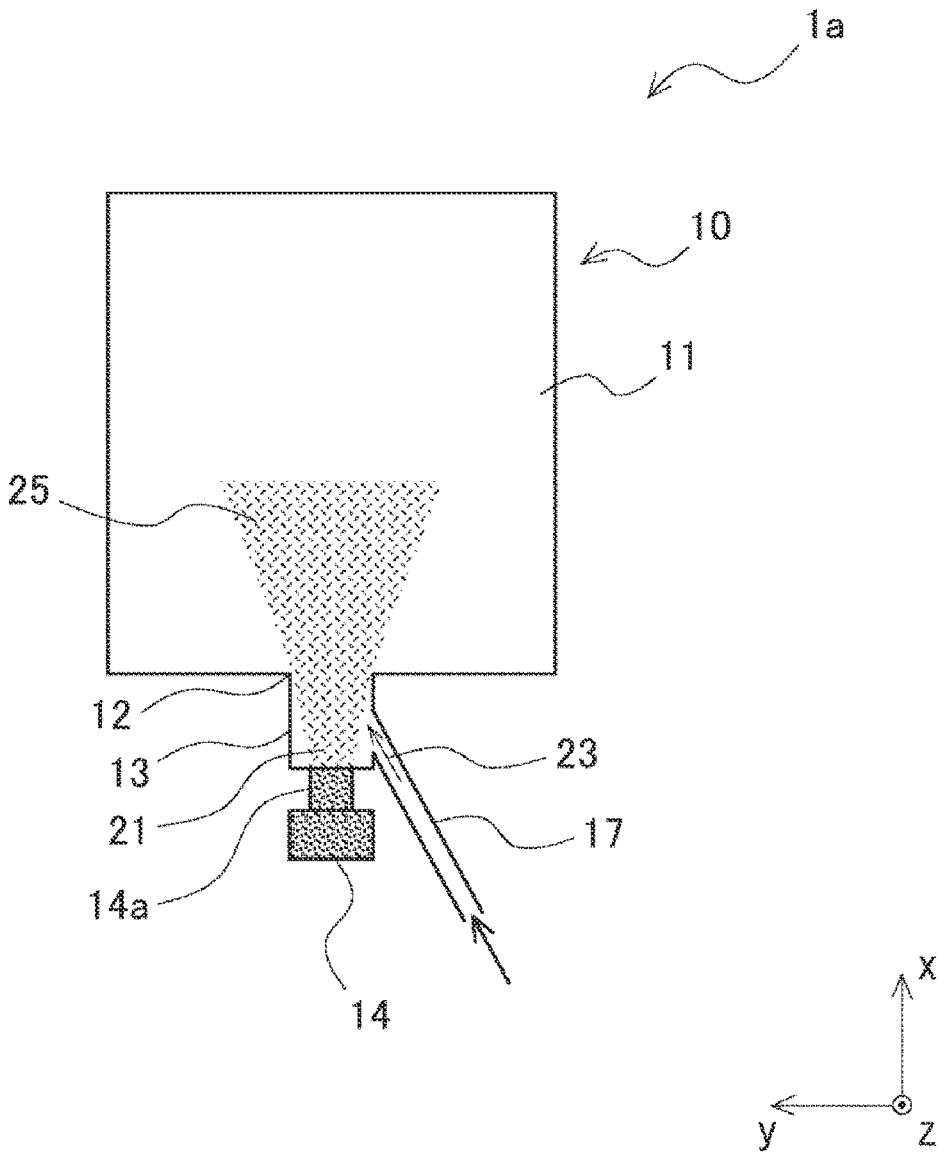
FIG. 2 is a sectional view for explaining another configuration example of the casting device according to the first embodiment.

FIG. 2 is a sectional view for explaining another configuration example of the casting device according to the first embodiment. A casting device 1*a* shown in FIG. 2 has a different arrangement of a gas flow path 17 compared to the casting device 1 shown in FIG. 1. The configurations of other components of the casting device 1*a* are the same as the configurations of the casting device 1 shown in FIG. 1.

As shown in FIG. 2, the gas flow path 17 of the casting device 1*a* is disposed such that a direction in which a gas 23 is supplied to the supply path 13 forms an acute angle with respect to a direction in which the molten metal 21 flows through the supply path 13 (in the x-axis direction). In this case as well, a shearing force of the gas 23 acts on the molten metal 21 as the gas 23 collides with the molten metal 21 flowing in the x-axis direction, which atomizes the molten metal 21. Further, supply of the atomized molten metal 25 to the cavity 11 can be promoted while the molten metal 21 is atomized by forming an acute angle by the direction in which the gas 23 is supplied to the supply path 13 with respect to the direction in which the molten metal 21 flows (the x-axis direction).

At this time, in the first embodiment, the direction in which the gas 23 is supplied to the supply path 13 may be configured to be adjustable. For example, as the angle formed by the direction in which the gas 23 is supplied to the supply path 13 with respect to the direction in which the molten metal 21 flows through the supply path 13 (the x-axis direction) becomes larger (becomes closer to the right angle), a colliding force of the gas 23 applied to the molten metal 21 increases, which promotes atomization of the molten metal 21. On the other hand, as the angle formed by the direction in which the gas 23 is supplied to the supply path 13 with respect to the direction in which the molten metal 21 flows through the supply path 13 (the x-axis direction) becomes smaller (as the direction in which the gas 23 is supplied to the supply path 13 becomes closer to the x-axis), a momentum of the atomized molten metal 25 flowing along the x-axis direction can be strengthened. Therefore, it is possible to promote supply of the atomized molten metal 25 to the cavity 11. In the first embodiment, the direction in which the gas 23 is supplied to the supply path 13, that is, the angle at which the gas 23 collides with the molten metal 21 flowing through the supply path 13, may be adjusted taken into account the above.

Note that, in FIG. 1, as examples, the number of the gas flow path 16 that is connected to the supply path 13 is one. However, according to the first embodiment, the number of the gas flow paths 16 that are connected to the supply path 13 may be two or more. In FIG. 2, as examples, the number of the gas flow path 17 that is connected to the supply path 13 is one. However, according to the first embodiment, the number of the gas flow paths 17 that are connected to the supply path 13 may be two or more.

Figure 3:
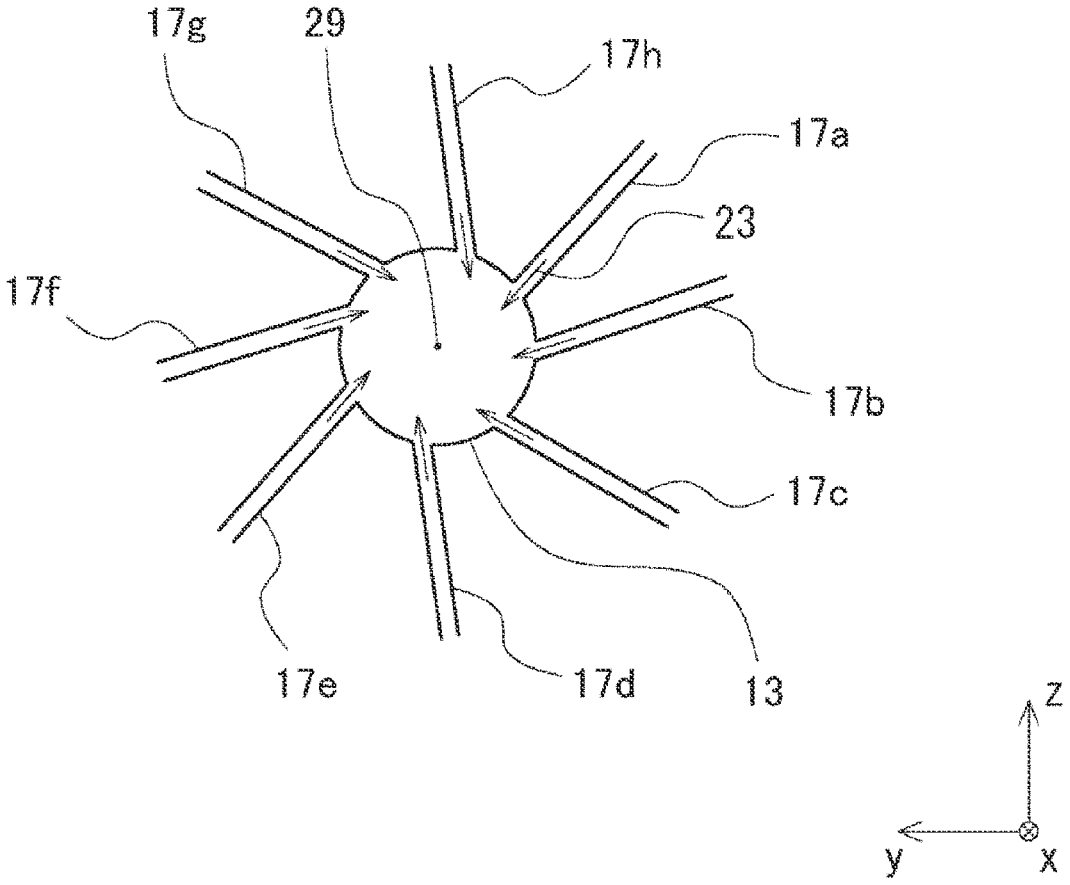
FIG. 3 is a sectional view for explaining still another configuration example of the casting device according to the first embodiment.

FIG. 3 is a sectional view for explaining another configuration example of the casting device according to the first embodiment, and shows an example in which a plurality of gas flow paths 17*a* to 17*h* is provided for the supply path 13. FIG. 3 shows an example in which a plurality of the gas flow paths 17, each of which corresponds to the one that is shown in FIG. 2, is disposed on a periphery of the supply path 13. That is, the gas flow paths 17*a* to 17*h* are each disposed such that, similar to the gas flow path 17 shown in FIG. 2, the direction in which the gas 23 is supplied to the supply path 13 forms an acute angle with respect to the direction in which the molten metal 21 flows through the supply path 13 (i.e. the x-axis direction).

The sectional shape of the supply path 13 shown in FIG. 3 is substantially circular, and the gas flow paths 17*a* to 17*h* are connected to the periphery of the supply path 13. At this time, the gas flow paths 17*a* to 17*h* are each disposed such that the direction in which the gas 23 is supplied to the supply path 13 is deviated from a central axis 29 of the supply path 13 when viewed in the direction in which the molten metal 21 flows through the supply path 13 (i.e. the x-axis direction).

The flow of the molten metal 21 in the supply path 13 can be rotated by disposing the gas flow paths 17*a* to 17*h* as described above. In the example shown in FIG. 3, the flow of the molten metal 21 in the supply path 13 along the x-axis direction can be rotated clockwise. When the flow of the molten metal 21 is rotated as described above, a centrifugal force acts on the molten metal 21, which promotes disturbance of the flow of the molten metal 21. Therefore, atomization of the molten metal 21 is promoted.

Also, in the configuration shown in FIG. 3, the direction in which the molten metal 25 is supplied from the supply path 13 to the cavity 11 may be controlled by adjusting the flow rates of the gas flowing through the respective gas flow paths 17*a* to 17*h*. For example, when it is desired to supply a larger amount of the molten metal 25 to the positive side of the cavity 11 in the y-axis direction, the supply amount of the gas 23 from the gas flow path on the negative side in the y-axis direction among the gas flow paths 17*a* to 17*h* is increased. On the contrary, when it is desired to supply a larger amount of the molten metal 25 to the negative side of the cavity 11 in the y-axis direction, the supply amount of the gas 23 from the gas flow path on the positive side in the y-axis direction among the gas flow paths 17*a* to 17*h* is increased. By using the method above, it is possible to supply the molten metal 25 mainly to the portion of the cavity 11 where supply of a larger amount of the molten metal 25 is required.

According to the first embodiment, the present disclosure can provide a casting device that enables atomization of the molten metal without increasing the gate speed of the molten metal.

Second Embodiment

Figure 4:
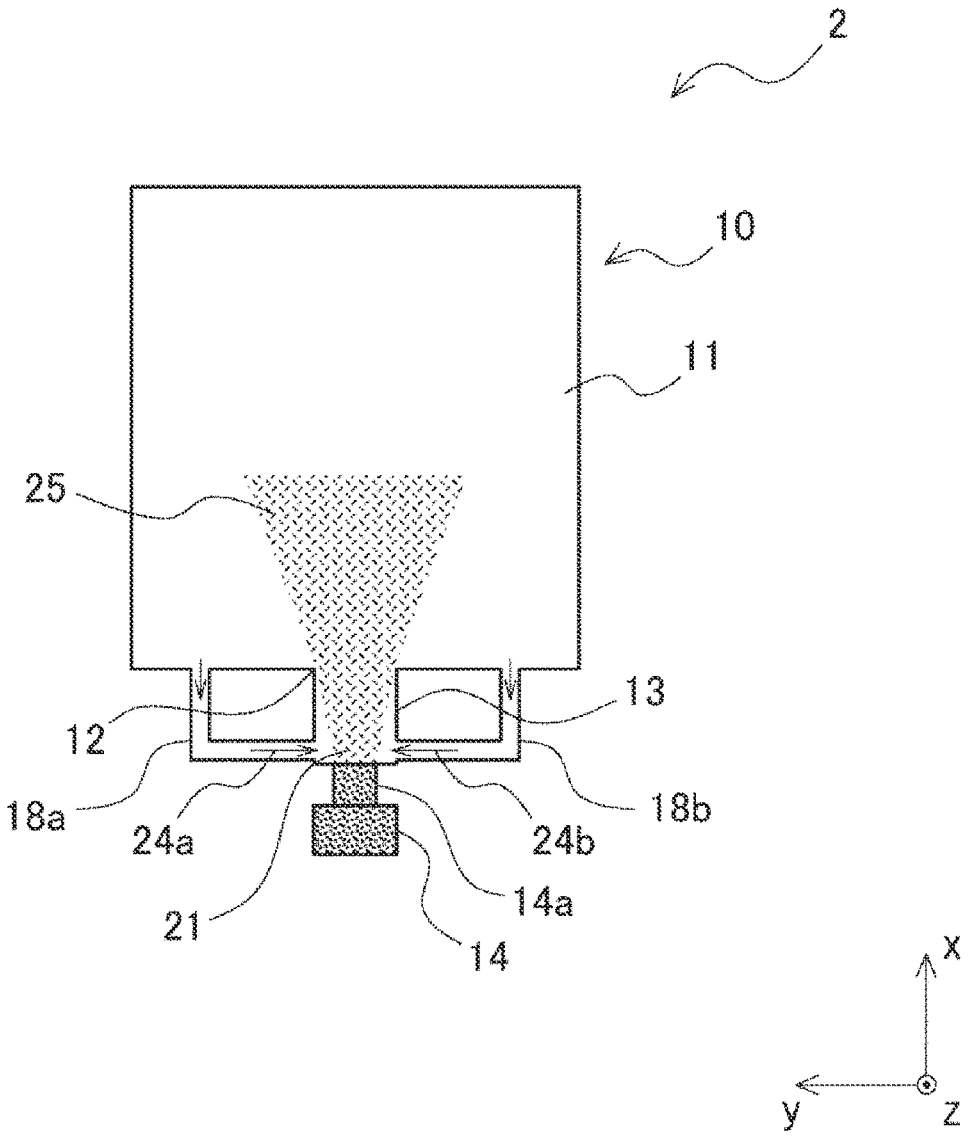
FIG. 4 is a sectional view for explaining a casting device according to a second embodiment.

Next, a second embodiment of the present disclosure will be described. FIG. 4 is a sectional view for explaining a casting device according to the second embodiment. As shown in FIG. 4, a casting device 2 according to the second embodiment includes the mold 10, the supply path 13, the molten metal supply portion 14, and gas flow paths 18*a*, 18*b*. Note that, the casting device 2 according to the second embodiment has different configurations of the gas flow paths 18*a*, 18*b*, compared to the casting device 1 described in the first embodiment (refer to FIG. 1). The configurations of the casting device 2 other than the gas flow paths are the same as those of the casting device 1 described in the first embodiment. Therefore, the same constituent elements are denoted by the same reference numerals, and redundant description thereof will be omitted.

As shown in FIG. 4, in the casting device 2 according to the second embodiment, the gas flow paths 18*a*, 18*b* are provided so as to connect spaces in the cavity 11 and the supply path 13. Specifically, one ends of the gas flow paths 18*a*, 18*b* are connected to the supply path 13, and the other ends of the gas flow paths 18*a*, 18*b* are connected to the cavity 11.

In the casting device 2 according to the second embodiment, the gas flow paths 18*a*, 18*b* are configured as described above. Therefore, the gas is supplied from the cavity 11 to the supply path 13 through the gas flow paths 18*a*, 18*b*. That is, when the molten metal 25 is supplied from the supply path 13 to the cavity 11, the air in the supply path 13 is pushed out from the supply path 13 due to the inertia force of the molten metal 25 and the viscous force of the air, which makes the pressure in the supply path 13 negative. With this configuration, the gas in the cavity 11 is sucked into the gas flow paths 18*a*, 18*b*, and sucked gases 24*a*, 24*b* are supplied to the supply path 13.

Figure 5:
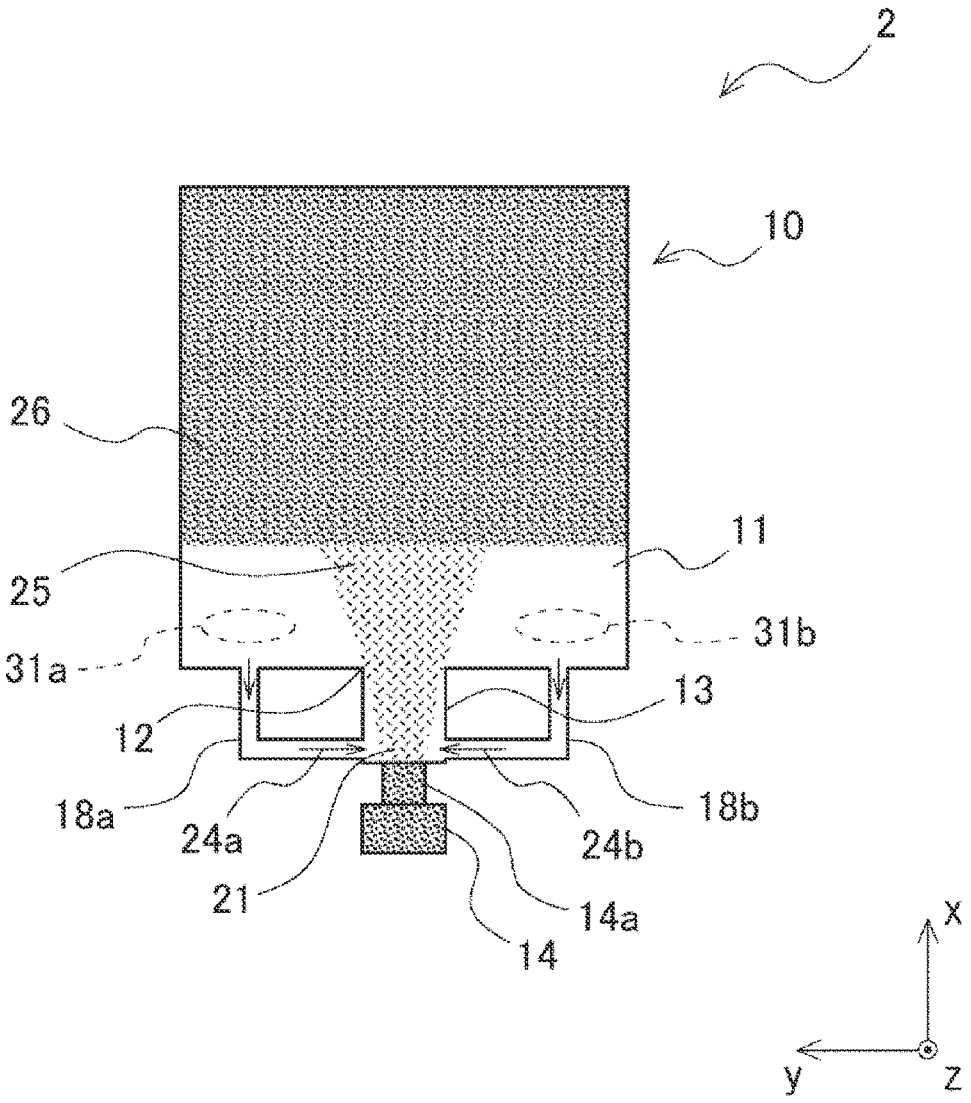
FIG. 5 is a sectional view for explaining the casting device according to the second embodiment.

Further, in the second embodiment, as shown in FIG. 5, the pressure in the cavity 11 increases as the molten metal 25 is supplied to the cavity 11 and thus a molten metal 26 is filled in the cavity 11. With this configuration, the gas in the cavity 11 is pushed out from the cavity 11 to the gas flow paths 18*a*, 18*b*, and the gases 24*a*, 24*b* that are pushed out from the cavity 11 is supplied to the supply path 13.

In the second embodiment, the gases 24*a*, 24*b* are supplied from the cavity 11 to the supply path 13 through the gas flow paths 18*a*, 18*b* by two actions as described above.

Further, in the second embodiment, with the configuration above, the air in the cavity 11 can be discharged from portions 31*a*, 31*b* in the cavity 11 where the air is likely to accumulate (refer to FIG. 5). That is, the cavity 11 includes the portions 31*a*, 31*b* where the molten metal does not flow as desired, and the air tends to accumulate in the portions 31*a*, 31*b*. In the second embodiment, the air can be discharged from the portions 31*a*, 31*b* of the cavity 11 where the air is likely to accumulate by connecting the gas flow paths 18*a*, 18*b* in the proximity to the portions 31*a*, 31*b*, respectively. With this configuration, accumulation of the air in the cavity 11 can be suppressed when the molten metal 26 is filled in the cavity 11, whereby the quality of the cast product can be improved.

For example, in the cavity 11, the molten metal tends to fail to flow as desired on the side closer to the gate 12. Therefore, for example, the gas flow paths 18*a*, 18*b* may be connected to respective positions that are closer to the gate 12 than the center of gravity of the cavity 11.

Further, FIG. 4 shows an example in which the casting device 2 is provided with two gas flow paths 18*a*, 18*b*. However, in the second embodiment, the number of the gas flow paths provided in the casting device 2 may be one, or three or more.

As described above, in the casting device 2 according to the second embodiment, the molten metal 21 is atomized by causing the gas 22 to collide with the molten metal 21 passing through the supply path 13. Therefore, the molten metal can be atomized without increasing the speed of the molten metal passing through the gate 12 (i.e. gate speed). Further, in the casting device 2 according to the second embodiment, there is no need to increase the gate speed. Therefore, an increase in the amount of heat transferred to the flow path of the molten metal and the mold can be suppressed, which can suppress occurrence of erosion and seizure.

Further, in the casting device 2 according to the second embodiment, one ends of the gas flow paths 18*a*, 18*b* are connected to the supply path 13, and the other ends of the gas flow paths 18*a*, 18*b* are connected to the cavity 11. Therefore, the air can be discharged from the portions 31*a*, 31*b* of the cavity 11 where the air is likely to accumulate, and thus it is possible to suppress accumulation of the air in the cavity 11. Accordingly, the quality of the cast product can be improved.

Figure 6:
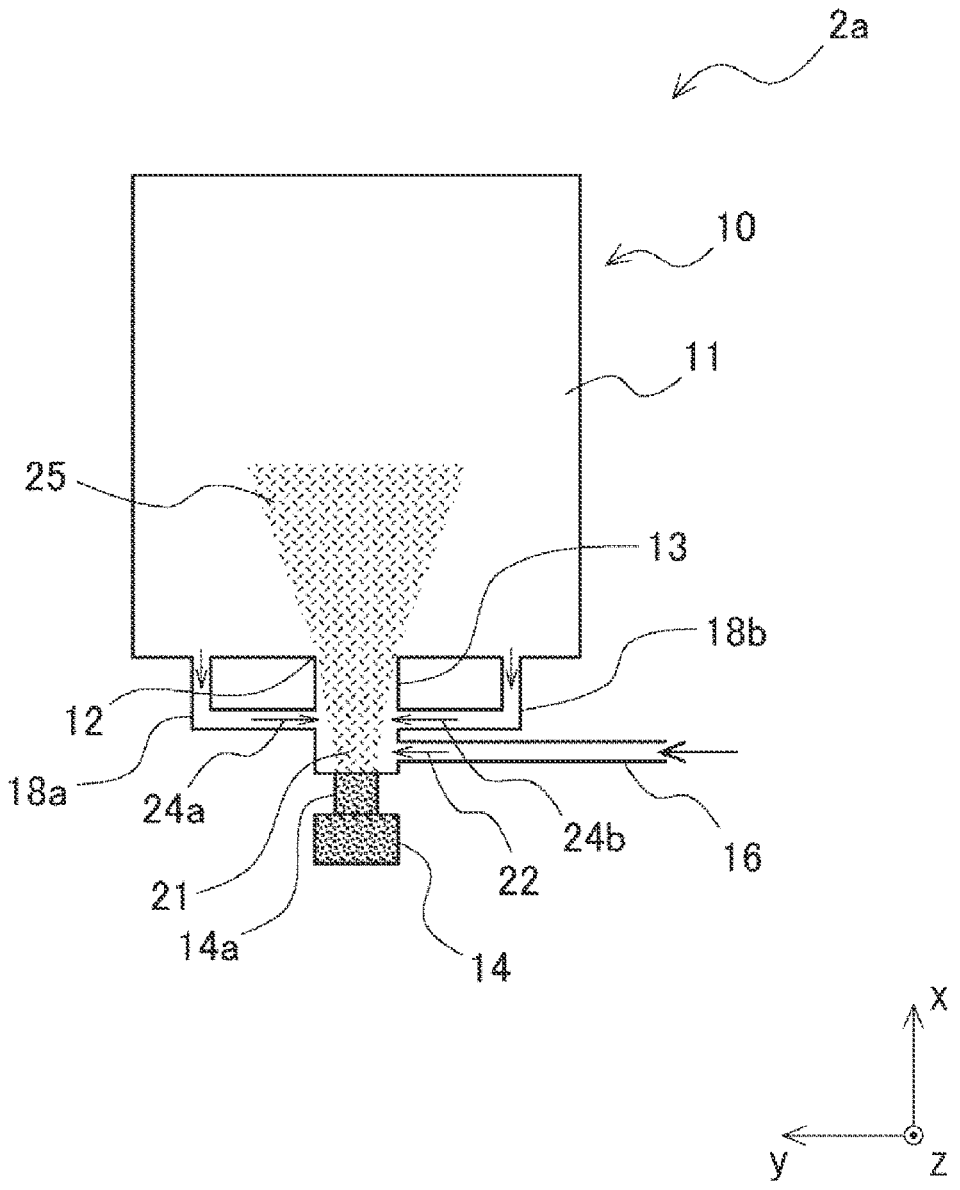
FIG. 6 is a sectional view for explaining another configuration example of the casting device according to the second embodiment.

Next, another configuration example of the casting device according to the second embodiment will be described. FIG. 6 is a sectional view for explaining another configuration example of the casting device according to the second embodiment. A casting device 2*a* shown in FIG. 6 is a configuration example in which the casting device 2 of the second embodiment that is shown in FIG. 4 and the casting device 1 of the first embodiment that is shown in FIG. 1 are combined. Among the configurations of the casting device 2*a* shown in FIG. 6, the configurations that are common to the configurations of the casting device 2 shown in FIG. 4 and the casting device 1 shown in FIG. 1 are denoted by the same reference numerals.

The casting device 2*a* shown in FIG. 6 includes the gas flow path (first gas flow path) 16 and the gas flow paths (second gas flow paths) 18*a*, 18*b*. The gas flow path 16 is connected to the supply path 13 and is configured to be capable of supplying the gas 22 to the supply path 13. One ends of the gas flow paths 18*a*, 18*b* are connected to the supply path 13 and the other ends of the gas flow paths 18*a*, 18*b* are connected to the cavity 11. The gases 24*a*, 24*b* is supplied from the cavity 11 to the supply path 13 through the gas flow paths 18*a*, 18*b*.

For example, in the casting device 2 shown in FIG. 4, the gases 24*a*, 24*b* are supplied from the cavity 11 to the supply path 13 through the gas flow paths 18*a*, 18*b*. However, depending on the amount of the molten metal 21 flowing through the supply path 13, there may be a case where the amounts of the gases 24*a*, 24*b* supplied to the supply path 13 are not enough, and thus the molten metal 21 flowing through the supply path 13 cannot be sufficiently atomized. In such a case, as in the casting device 2*a* shown in FIG. 6, the molten metal 21 flowing through the supply path 13 can be sufficiently atomized by further providing the gas flow path 16 and supplying the gas 22 to the supply path 13. That is, the gas required for atomizing the molten metal 21 can be supplemented by additionally providing the gas flow path 16. Therefore, atomization of the molten metal 21 flowing through the supply path 13 can be promoted.

As described above, the gas 22 supplied from the gas flow path 16 to the supply path 13 may be the air or an inert gas. As the inert gas, nitrogen gas and argon gas, for example, may be used.

Further, the flow rate (flow velocity) of the gas 22 supplied from the gas flow path 16 to the supply path 13 may be adjusted in accordance with the flow rate (speed) of the molten metal 21 passing through the supply path 13. For example, as the flow rate of the molten metal 21 passing through the supply path 13 increases, the flow rate of the gas 22 supplied from the gas flow path 16 to the supply path 13 may be increased. For example, the flow rate of the gas 22 supplied from the gas flow path 16 to the supply path 13 can be adjusted by providing a flow rate adjusting valve in the gas flow path 16.

As described above, the gas 22 supplied from the gas flow path 16 to the supply path 13 may be supplied to the supply path 13 when the pressure in the supply path 13 becomes negative. Further, the gas 22 may be supplied from the gas flow path 16 to the supply path 13 by supplying the pressurized gas to the gas flow path 16. For example, the compressed air that is pressurized at a predetermined pressure may be supplied from the gas flow path 16 to the supply path 13.

Further, similar to the gas flow path 17 shown in FIG. 2, the gas flow path 16 may be disposed such that the direction in which the gas is supplied to the supply path 13 forms an acute angle with respect to the direction in which the molten metal 21 flows through the supply path 13 (i.e. the x-axis direction).

The embodiments for carrying out the present disclosure have been described above, but the present disclosure is not limited to the specific embodiments as described above. The present disclosure includes various modifications, corrections, and combinations that can be made by those who are skilled in the art without departing from the scope of the present disclosure described in the claims.

What is claimed is:

1. A casting device, comprising:

a mold having a cavity;

a supply path that is connected to a gate of the cavity and configured to supply a molten metal to the cavity; and a gas flow path that is connected to the supply path and configured to supply a gas to the supply path, wherein the casting device is configured so that the molten metal is atomized by causing the gas supplied from the gas flow path to collide with the molten metal passing through the supply path, and the molten metal that is atomized is supplied to the cavity.

2. The casting device according to claim 1, further comprising a molten metal supply portion that is connected to the supply path and configured to supply the molten metal to the supply path, wherein the molten metal supply portion is configured such that a sectional area of the molten metal supply portion is smaller than a sectional area of the supply path at a portion at which the molten metal supply portion is connected to the supply path.

3. The casting device according to claim 1, wherein the gas flow path is disposed such that a direction in which the gas is supplied to the supply path forms an acute angle with respect to a direction in which the molten metal flows through the supply path.

4. The casting device according to claim 3, wherein:

a sectional shape of the supply path is circular;

a plurality of the gas flow paths is connected to a periphery of the supply path; and the gas flow paths are each disposed such that the direction in which the gas is supplied to the supply path is deviated from a central axis of the supply path when viewed in the direction in which the molten metal flows through the supply path.

5. The casting device according to claim 1, wherein:

a first end of the gas flow path is connected to the supply path;

a second end of the gas flow path is connected to the cavity; and the gas is supplied from the cavity to the supply path through the gas flow path.

6. The casting device according to claim 1, wherein:

the gas flow path includes a first gas flow path and a second gas flow path;

the first gas flow path is connected to the supply path and configured to supply a first gas to the supply path; and a first end of the second gas flow path is connected to the supply path and a second end of the second gas flow path is connected to the cavity such that the gas is supplied from the cavity to the supply path through the second gas flow path.

* * * * *